US008287070B2

(12) United States Patent
Yamashita

(10) Patent No.: US 8,287,070 B2
(45) Date of Patent: Oct. 16, 2012

(54) DRIVE CONTROL APPARATUS AND INK-JET PRINTER PROVIDED WITH THE SAME

(75) Inventor: Toru Yamashita, Nagoya (JP)

(73) Assignee: Brother Kogyo kabushiki Kaisha, Aichi-Ken (JP)

( * ) Notice: Subject to any disclaimer, the term of this patent is extended or adjusted under 35 U.S.C. 154(b) by 288 days.

(21) Appl. No.: 12/728,576

(22) Filed: Mar. 22, 2010

(65) Prior Publication Data

US 2010/0245424 A1 Sep. 30, 2010

(30) Foreign Application Priority Data

Mar. 30, 2009 (JP) ..... 2009-081287

(51) Int. Cl.
*B41J 29/38* (2006.01)

(52) U.S. Cl. ..... 347/10; 347/5

(58) Field of Classification Search ..... 347/5, 9–12, 347/15

See application file for complete search history.

(56) References Cited

U.S. PATENT DOCUMENTS

| | | | | |
|---|---|---|---|---|
| 7,438,372 | B2 * | 10/2008 | Imai | 347/10 |
| 2004/0001122 | A1 * | 1/2004 | Miyata | 347/68 |
| 2005/0204365 | A1 | 9/2005 | Imai | |

FOREIGN PATENT DOCUMENTS

| | | |
|---|---|---|
| JP | 2005-225004 | 8/2005 |

* cited by examiner

*Primary Examiner* — Geoffrey Mruk
(74) *Attorney, Agent, or Firm* — Frommer Lawrence & Haugg LLP

(57) ABSTRACT

A control circuit of a printer makes a signal selecting circuit select a connection signal of a checking circuit, and then make output, to one driver IC which detects a connection state with the control circuit. The control circuit outputs a selection signal which makes the signal selecting circuit select a temperature detection signal of a temperature sensor, and then make output, to the remaining driver ICs.

8 Claims, 9 Drawing Sheets

DRIVE CONTROL APPARATUS AND INK-JET PRINTER PROVIDED WITH THE SAME

CROSS REFERENCE TO RELATED APPLICATION

The present application claims priority from Japanese Patent Application No. 2009-081287, filed on Mar. 30, 2009, the disclosure of which is incorporated herein by reference in its entirety.

BACKGROUND OF THE INVENTION

1. Field of the Invention

The present invention relates to a drive control apparatus having a plurality of driving circuits which drive an object based on a signal inputted from a control circuit, and an ink-jet printer including the drive control apparatus.

2. Description of the Related Art

Apparatuses, which are used in various technical fields for driving various objects, normally include a driving circuit which drives an object based on a signal from a control circuit. In order to control product quality of such apparatuses, a check for an electrical conduction defect in a signal system including connections from the control circuit up to the driving circuit through signal wires is sometimes carried out.

For instance, in certain ink jet heads, a driving circuit (driver IC) which drives the ink-jet head is connected to a driving circuit of a printer via a plurality of signal wires on wiring members. Moreover, the driving circuit controls the ink jet head based on a plurality of types of waveform data and clock signals, or data of as to which waveform data is to be selected for each of the nozzles. Moreover, the driving circuit is provided with a checking circuit which checks a defect of the electronic connection between the driving circuit and the control circuit. An input of the signal wires is connected to the checking circuit, and when a checking signal is input to the driving circuit from a certain signal wire, a different signal is output to the control circuit depending on whether or not that signal has been input properly to check circuit. Accordingly, whether or not there is an electrical conduction defect in the signal wire is detected.

SUMMARY OF THE INVENTION

In recent years, in accordance with an increase in the number of drive elements (drive targets) provided to the object, an apparatus which has a plurality of driving circuits, and which is structured to drive an object by the plurality of driving circuits has been known. For instance, in the abovementioned example of the ink-jet head, to meet demands of a high-speed printing and high-resolution printing, in recent years, there is a tendency toward increasing the number of nozzles. However, in accordance with the increase in the number of nozzles, since it is difficult to control jetting of all the nozzles by one driving circuit, controlling the ink jet head by the plurality of driving circuit is taken into consideration.

In this case, signals which are to be used in common in the plurality of driving circuits, such as the abovementioned waveform data and the clock signal are supplied in common from the control circuit to the plurality of driving circuits by common signal wires. Whereas, signals which are different in each driving circuit such as data for selecting a waveform for each nozzle are supplied from the control circuit to the plurality of driving circuits via separate signal wires.

In an apparatus having the plurality of driving circuits as described above, in a case of checking whether there is an electric conduction defect in a signal system from the control circuit to the plurality of driving circuits, a checking signal is input from the control circuit through the common signal wire and the plurality of individual signal wires, and an electric conduction defect is detected based on a signal output from the checking circuits each provided in one of the driving circuits.

Here, a plurality of signal wires for outputting signals according to checking result of an electrical conduction defect from the plurality of checking circuits to the control circuit may be provided separately. However, for example, when it is possible to output an output of the plurality of checking signals to the control unit together by one wired OR, it is possible to reduce the number of signal wires, and to reduce the cost.

However, at the time of checking an electrical conduction defect of the common signal wires, the checking signal output from the control circuit is input to all the driving circuits via the common signal wires, and signals according to an electrical conduction state are output from the checking circuit in all the driving circuits respectively. At this time, when the signals output from the checking circuits are put together as one, it is possible to detect that there is an electrical conduction defect in a common-signal system from the control circuit up to the plurality of driving circuits via the common signal wires. However, it is not possible to specify the signal wire, in the common-signal systems, at which an electrical conduction defect occurs.

Therefore, an object of the present invention is to provide a drive control apparatus which is capable of detecting as to in which signal wire there is an electrical conduction defect, from among the plurality of signal wires in the common-signal system from the control circuit up to the plurality of driving circuits, while facilitating lining-saving, and to provide an ink jet printer which includes such drive control system.

According to a first aspect of the present invention, there is provided a drive control apparatus which controls a drive target, including:

a control circuit which has a plurality of individual signal-input terminals, a plurality of individual signal-output terminals, and a common signal-output terminal, and which outputs a predetermined checking signal from one individual signal-output terminal among the individual signal-output terminals, and outputs a predetermined selection signal from another individual signal-output terminal among the individual signal-output terminals;

a plurality of driving circuits which drives the drive target based on a signal inputted from the control circuit, each of the driving circuits including:

a plurality of individual signal-input terminals;

a common signal-input terminal;

a connection-signal generating circuit which outputs a connection signal, an electric potential level of which is a predetermined first electric potential, under a condition that the checking signal outputted from the one individual signal-output terminal of the control circuit is inputted to the connection-signal generation circuit, and is a predetermined second electric potential that differs from the first electric potential, under a condition that the checking signal is not inputted to the connection-signal generation circuit;

an operation-signal generating circuit which outputs an operation-signal, an electrical potential level of which is between the first electric potential and the second electric potential; and a signal selecting circuit to which the connection signal outputted from the connection-signal generating circuit and the operation-signal outputted from the operation-signal generating circuit are inputted, and which selects, based on the selection signal inputted from the control circuit, one of the connection signal and the operation-signal, and outputs the selected signal as an output signal;

a plurality of individual signal wires which connect the individual signal-output terminals of the control circuit and the individual signal-input terminals of the driving circuit respectively;

a common signal wire which connects in common, the common signal-input terminal of each of the driving circuits and the common signal-output terminal of the control circuit; and an output-signal integrating section which integrates the output signals of the connection-signal selecting circuits to one output signal such that the output-signal integrating section outputs one of an output signal of a highest electric potential level and an output signal of a lowest electric potential level, among the output signals of the connection-signal selecting circuits, wherein the control circuit outputs a selection signal by which the signal selecting circuit is made to select and output the connection-signal generating circuit for one driving circuit among the driving circuits in which a connection state with the control circuit is checked, and outputs a selection signal by which the signal selecting circuit is made to select and output the operation-signal generating circuit for remaining driving circuits other than the one drive circuit.

In this case, at the time of checking whether there is an electrical conduction defect in the signal system from the control circuit up to the plurality of driving circuits via the individual signal wires or the common signal wire, the checking signal is outputted from the control circuit, and depending on whether or not the checking signal has been input properly, the connection signal is outputted from the connection-signal generating circuit. Furthermore, based on the selection signal inputted to the signal selecting circuit, the signal selecting circuit outputs the connection signal from the connection-signal generating circuit to an outside (such as to the control circuit), and the electrical conduction defect is detected according to this connection signal. Moreover, when the electrical conduction defect is not to be checked, the signal selecting circuit outputs the operation signal from the operation-signal generating circuit to the outside, based on the selection signal inputted to the signal selecting circuit. At this time, the connection signal is made to be outputted from the signal selecting circuit only to one driving circuit which checks whether there is an electrical conduction defect, and the operation signal is made to be output from the signal selecting circuit to the other driving circuits.

In this case, in the driving circuit subjected to checking, since the output from the connection-signal generating circuit is inputted, when there is no electrical conduction defect in the signal system, the selection signal of the first electric potential is output from the driving circuit, and when there is an electrical conduction defect, the selection signal of the second electric potential is outputted from the driving circuit. Moreover, since the output from the operation-signal generating circuit is selected from the other driving circuits, an operation signal between the first electric potential and the second electric potential is outputted. Here, the description will be made by citing an example of a case in which, the first electric potential is lower than the second electric potential, and a wired OR is used as the output-signal integrating section. When there is no electrical conduction defect from the wired OR up to the control circuit, the first electric potential is outputted from the connection-signal generating circuit of the driving circuit to be checked, and an operation signal between the first electric potential and the second electric potential is outputted from the operation-signal generating circuit of the other driving circuit. Therefore, in this case, a connection signal of the first electric potential which is a signal of a lower electric potential level is outputted. Whereas, when there is an electrical conduction defect such as a faulty connection (faulty electrical conduction) in the signal system in the driving circuit to be checked, an operation signal of an electric potential level lower than that of the connection signal of the second electric potential is outputted from the wired OR to the control circuit.

In such manner, the connection signal is selected and made to be outputted from the signal connecting circuit only to one driving circuit to which the signal wire to be checked for whether there is an electric conduction defect has been connected, and it is possible to detect an electrical conduction defect according to the output to the control circuit from the wired OR when the operation signal of an electric potential different from an electric potential of the connection signal is selected and made to be outputted from the signal connecting circuit from the other driving circuits. Consequently, it is possible to detect as to which of common signal systems has an electrical conduction defect, from among the common signal systems from the control circuit up to the plurality of driving circuits via the common signal wire, while facilitating lining-saving.

DETAILED DESCRIPTION OF THE PREFERRED EMBODIMENTS

Next, an embodiment of present teachings will be described below. The embodiment described below is an example in which the present teachings are applied to an ink-jet printer which includes an ink-jet head which jets droplets of ink onto a recording paper.

Figure 1:
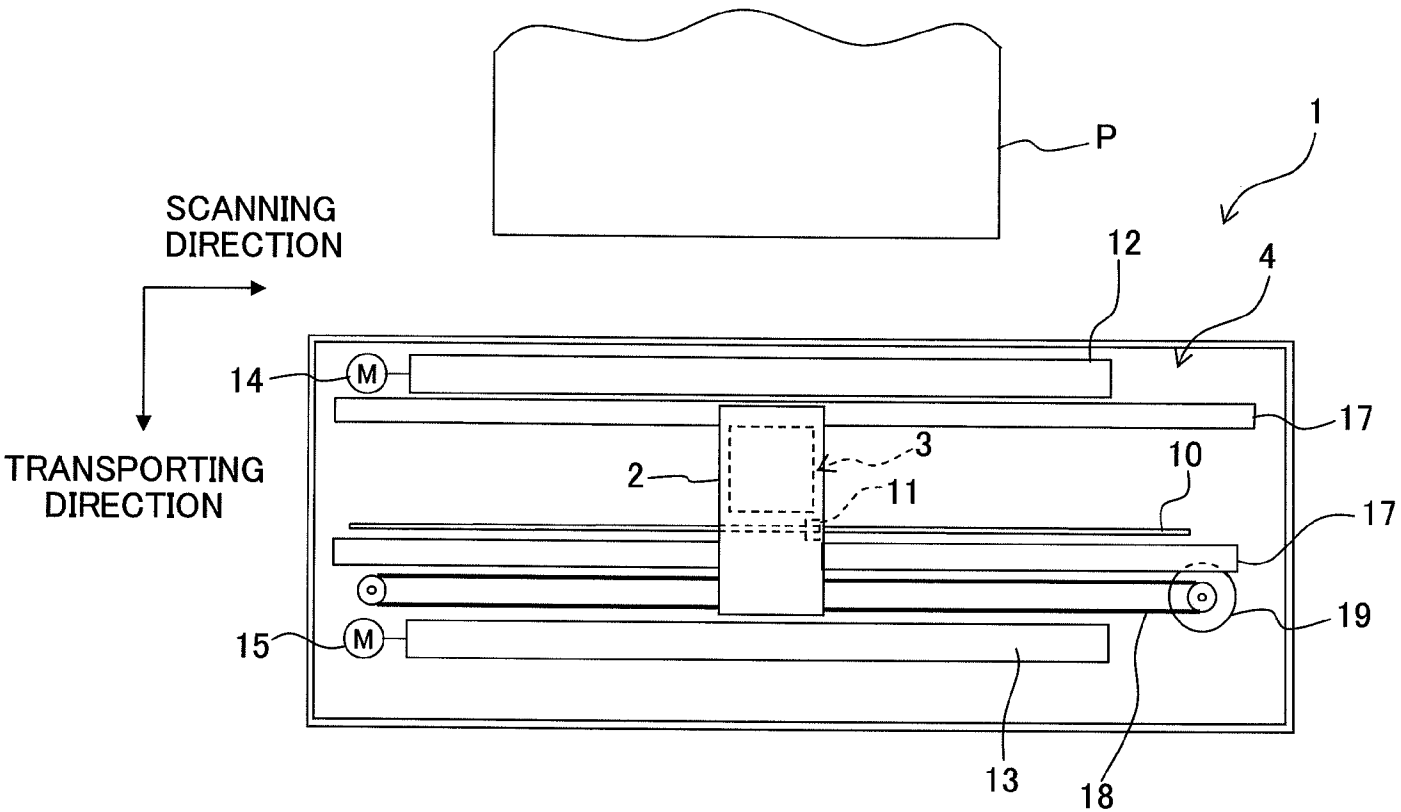
FIG. 1 is a schematic plan view of an ink-jet printer according to an embodiment of the present invention.

Firstly, a schematic structure of an ink jet printer (a printer) 1 of the embodiment will be described below. As shown in FIG. 1, the printer 1 includes a carriage 2 which reciprocates in a predetermined scanning direction (left-right direction in FIG. 1), an ink-jet head 3 which is mounted on the carriage 2, and a transporting mechanism 4 which transports a recording paper P in a transporting direction that is orthogonal to the scanning direction.

The carriage 2 reciprocates along two guide shafts 17 extended in parallel to the scanning direction (left-right direction in FIG. 1). Moreover, an endless belt 18 is coupled with (connected to) the carriage 2, and when the endless belt 18 is driven to run by a carriage driving motor 19, the carriage 2 moves in the scanning direction with the running of the endless belt 18. The printer 1 is provided with a linear encoder 10, which has a multiple number of light transmission portions (slits) arranged in a row at an interval in the scanning direction. Whereas, the carriage 2 is provided with a photo sensor 11 of a transmission type, which has a light emitting element and a light receiving element. Moreover, in the printer 1, it is possible to identify a current position of the carriage 2 in the scanning direction based on a measured counts (detection counts) of the light transmission portion of the linear encoder 10, which has been detected by the photo sensor 11 during the movement of the carriage 2.

The ink-jet head 3 is mounted on the carriage 2. The ink-jet head 3 has a plurality of nozzles 30 (refer to FIGS. 2 to 4) in a lower surface thereof (a surface on the other side of a paper plane in FIG. 1). The ink-jet head 3 is structured such that, an ink supplied from an ink cartridge which is not shown in the diagram is jetted from the plurality of nozzles 30 onto the recording paper P transported to a lower side (transporting direction) in FIG. 1 by the transporting mechanism 4.

The transporting mechanism 4 includes a paper feeding roller 12 which is arranged at an upstream side of the ink-jet head 3 in the transporting direction, and a paper discharge roller 13 which is arranged at a downstream side of the ink-jet head 3 in the transporting direction. The paper feeding roller 12 and the paper discharge roller 13 are driven to rotate by a paper feeding motor 14 and a paper discharge motor 15 respectively. Moreover, the transporting mechanism 4 transports the recording paper P from an upper side in FIG. 1 to the ink-jet head 3 by the paper feeding roller 12, and discharges the recording paper P, on which an image or characters are recorded by the ink jet head 3, to the lower side in FIG. 1, by the paper discharge roller 13.

Figure 2:
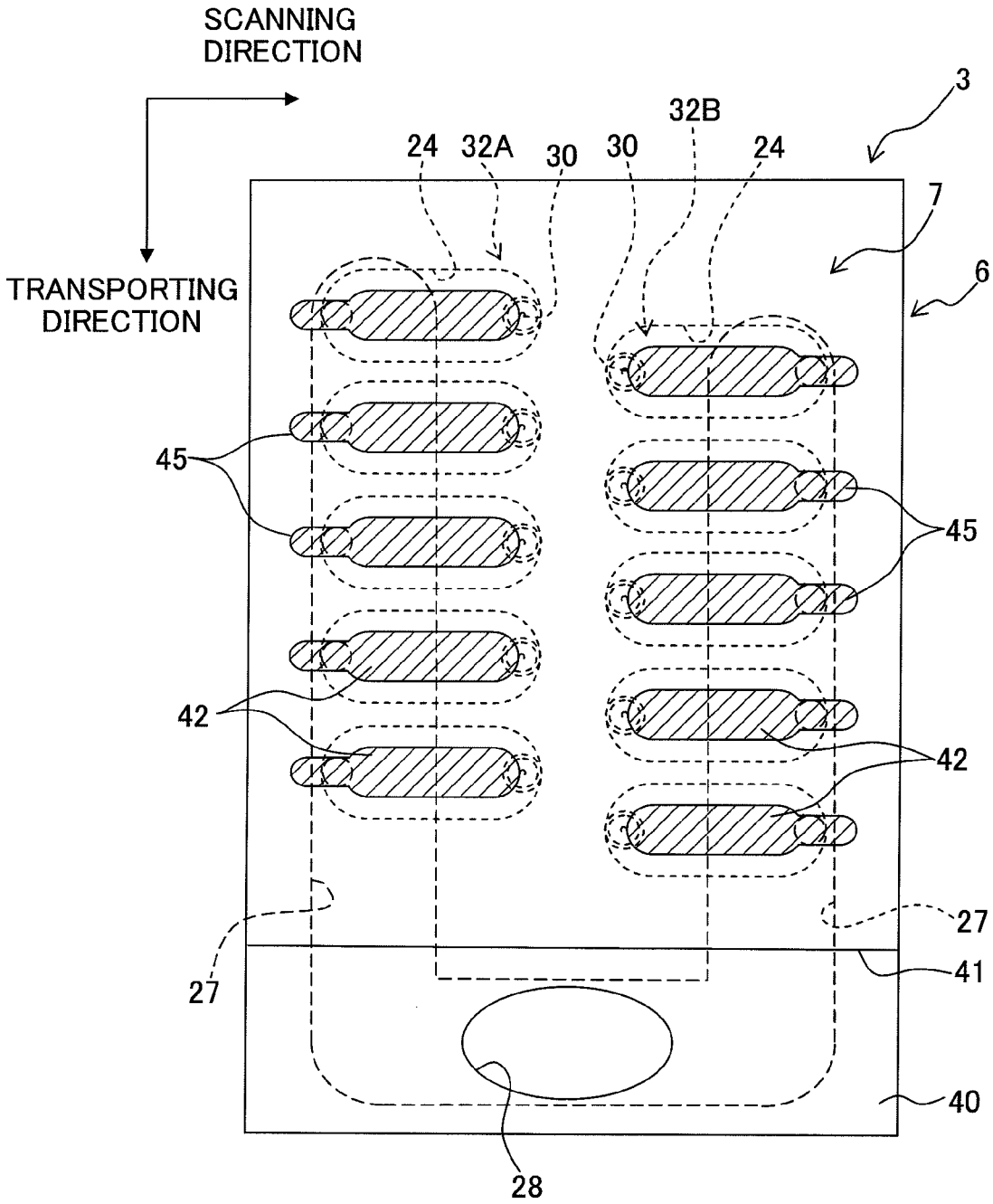
FIG. 2 is a plan view of the ink-jet head.
Figure 3:
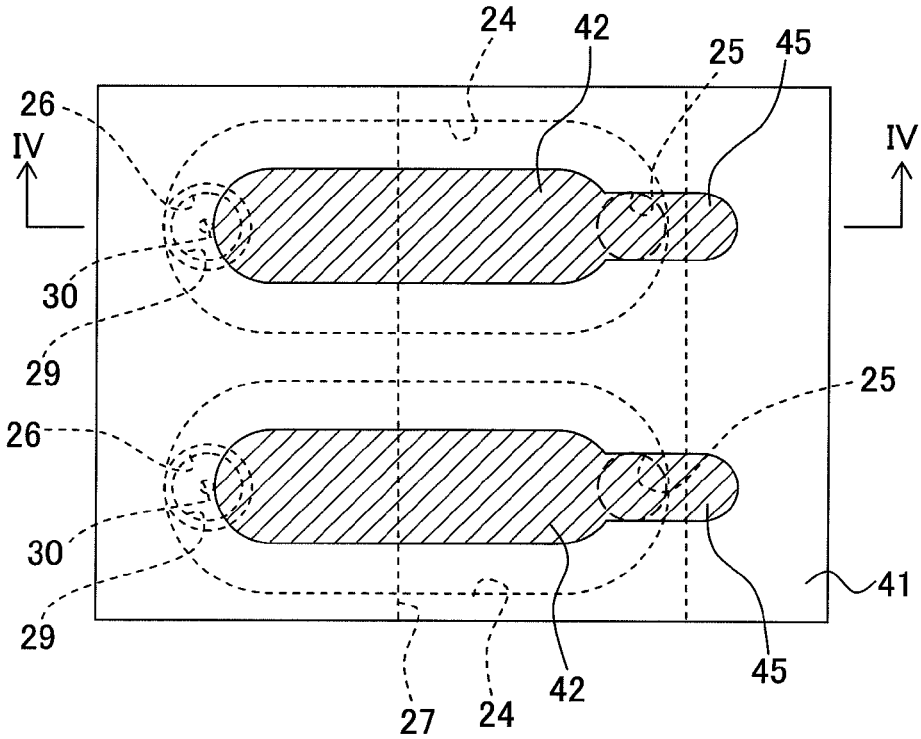
FIG. 3 is a partially enlarged view of FIG. 2.
Figure 4:
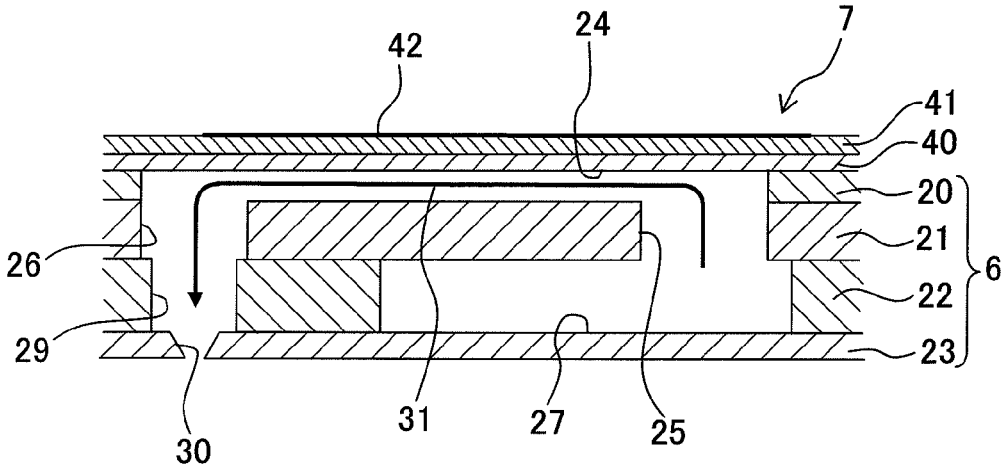
FIG. 4 is a cross-sectional view taken along a line IV-IV in FIG. 3.

Next, the ink-jet head 3 will be described below. As shown in FIGS. 2 to 4, the ink-jet head 3 includes a channel unit 6 in which ink channels including the nozzles 30 and pressure chambers 24 are formed, and a piezoelectric actuator 7 which applies a pressure to the ink in the pressure chamber 24.

Firstly, the channel unit 6 will be described below. As shown in FIG. 4, the channel unit 6 includes a cavity plate 20, a base plate 21, a manifold plate 22, and a nozzle plate 23, and these four plates 20 to 23 are stacked and joined with each other. The cavity plate 20, the base plate 21, and the manifold plate 22 are plates having a substantially rectangular shape in a plan view, formed of a metallic material such as stainless steel. Therefore, it is possible to form easily, channels such as the pressure chamber 24 and the manifold 27 which will be described later, in these three plates 20 to 22 by etching. Moreover, the nozzle plate 23 is formed of a high-molecular synthetic resin material such as polyimide, and is joined to a lower surface of the manifold plate 22 by an adhesive. Or, the nozzle plate 23 may also be formed of a metallic material such as stainless steel, similarly as the other three plates 20 to 22.

As shown in FIGS. 2 to 4, a plurality of holes cut through the cavity plate 20 is formed in the cavity plate 20 which is at an uppermost position, out of the four plates 20 to 23. Accordingly, the plurality of pressure chambers 24 arranged in a row along a planar direction of the cavity plate 20 is formed in the cavity plate 20. Moreover, the pressure chambers 24 are arranged in two rows in a staggered form in the transporting direction (vertical direction in FIG. 2). Moreover, as shown in FIG. 4, the pressure chambers 24 are covered by the base plate 21 and a vibration plate 40 which will be described later, from an upper side and a lower side, respectively. Furthermore, each of the pressure chambers 24 is formed to be substantially elliptical shaped with a longer axis of the elliptical shape in the scanning direction (left-right direction in FIG. 2). In other words, a longitudinal direction of each of the pressure chambers 24 coincides with the scanning direction.

As shown in FIGS. 3 and 4, communicating holes 25 and 26 are formed in the base plate 21, at positions overlapping with two end portions in the longitudinal direction of the pressure chamber 24 in a plan view. Moreover, the two manifolds 27 extended in the transporting direction are formed in an area of the manifold plate 22, overlapping with portions toward the communicating holes 25 of the pressure chambers 24 arranged in two rows. These two manifolds 27 communicate with an ink supply port 28 formed in the vibration plate 40 which will be described later, and ink is supplied from an ink tank not shown in the diagram, to the manifold 27 via the ink supply port 28. Furthermore, a plurality of communicating holes 29 communicating with the plurality of communicating holes 26 is also formed in the manifold plate 22, at positions overlapping with end portions of the pressure chambers 24 in a plan view, on an opposite side of the manifold 27.

Furthermore, the plurality of nozzles 30 is formed in the nozzle plate 23, at positions overlapping with the plurality of communicating holes 29 in a plan view. As shown in FIG. 2, the plurality of nozzles 30 is arranged to overlap with the end portions of the pressure chambers 24 arranged in two rows along the transporting direction on the opposite side of the manifold 27. In other words, the plurality of nozzles 30 is arranged in rows in a staggered form corresponding to the plurality of pressure chambers 24 arranged in a staggered form, and forms two nozzle rows 32A and 32B arranged side-by-side in the scanning direction.

Moreover, as shown in FIG. 4, the manifold 27 communicates with the pressure chambers 24 via the communicating holes 25, and furthermore, each of the pressure chambers 24 communicates with one of the nozzle 30 via the communicating holes 26 and 29. In this manner, a plurality of ink channels 31 running from the manifold 27 to the nozzles 30 via the pressure chambers 24 is formed in the channel unit 6.

In FIG. 2, for simplifying the description, only one group of interconnected channels (including the manifolds 27, the pressure chambers 24, and the nozzles 30) communicating with one ink supply port 28 is indicated. However, the present teachings are not restricted to the one group of interconnected channels. For instance, the ink-jet head 3 may have a plurality of groups of interconnected channels arranged side-by-side in the scanning direction, and furthermore, the ink-jet head 3 may be a color ink-jet head which has a plurality of groups of interconnected channels for jetting different color inks (for example, four colors namely, black, yellow, cyan, and magenta).

Next, the piezoelectric actuator 7 will be described below. As shown in FIGS. 2 to 4, the piezoelectric actuator 7 includes the vibration plate 40 which is arranged on an upper surface of the channel unit (the cavity plate 20) to cover the plurality of pressure chambers 24, a piezoelectric layer 41 which is arranged on an upper surface of the vibration plate 40, facing the plurality of pressure chambers 24, and a plurality of individual electrodes 42 which is arranged on an upper surface of the piezoelectric layer 41.

The vibration plate 40 is a metallic plate having a substantially rectangular shape in a plan view, and is made of a material such as an iron alloy (for example stainless steel), a copper alloy, a nickel alloy, or a titanium alloy. The vibration plate 40 is joined to the cavity plate 20, upon being installed to cover the plurality of pressure chambers 24 on the upper surface of the cavity plate 20. Moreover, an upper surface of the vibration plate 40 which is electroconductive is arranged on a lower-surface side of the piezoelectric layer 41. Therefore, the upper surface of the vibration plate 40 is also capable of serving as a common electrode, and generates an electric field in the piezoelectric layer 41, between the plurality of individual electrodes 42 on the upper surface and the vibration plate 40, in a thickness direction of the piezoelectric layer 41. The vibration plate 40 as the common electrode is connected to a ground wire of a driver IC 47 (refer to FIG. 5) which drives the piezoelectric actuator 7, and is kept at a ground electric potential all the time.

The piezoelectric layer 41 is made of a piezoelectric material having lead zirconate titanate (PZT) as a main component, which is a solid solution of lead titanate and lead zirconate. As shown in FIG. 2, the piezoelectric layer 41 is formed on the upper surface of the vibration plate 40, continuously spread over the plurality of pressure chambers 24. Moreover, the piezoelectric layer 41 is polarized in the thickness direction in an area facing at least the pressure chamber 24.

The plurality of individual electrodes 42 is arranged on the upper surface of the piezoelectric layer 41, in an area facing the plurality of pressure chambers 24. Each of the individual electrodes 42 has a substantially elliptical shape slightly smaller than the pressure chamber 24 in a plan view, and faces a central portion of the pressure chamber 24. Moreover, a plurality of contact-point portions 45 is drawn in a longitudinal direction of the individual electrodes 42 from end portions of the plurality of individual electrodes 42.

Next, an operation of the piezoelectric actuator 7 at the time of jetting an ink will be described below. When a predetermined driving electric potential is applied to a certain individual electrode 42 from the driver IC 47, an electric potential difference is developed between the individual electrode 42 to which the driving electric potential is applied and the vibration plate 40 as a common electrode which is kept at the ground electric potential, and an electric field in the thickness direction acts in the piezoelectric layer 41 sandwiched between the individual electrode 42 and the vibration plate 40. Since a direction of the electric field is parallel to a direction in which the piezoelectric layer 41 is polarized, the piezoelectric layer 41 in an area (an active area) facing the individual electrode 42 contracts in a planar direction which is orthogonal to the thickness direction. Here, since the vibration plate 40 on the lower side of the piezoelectric layer 41 is fixed to the cavity plate 20, a portion of the vibration plate 40 covering the pressure chamber 24 is deformed to form a projection toward the pressure chamber 24 (unimorph deformation) with the contraction in the planar direction of the piezoelectric layer 41 positioned on the upper surface of the vibration plate 40. At this time, since a volume in the pressure chamber 24 decreases, an ink pressure inside the pressure chamber 24 rises up and the ink is jetted form the nozzle 30 communicating with this pressure chamber 24.

Figure 5:
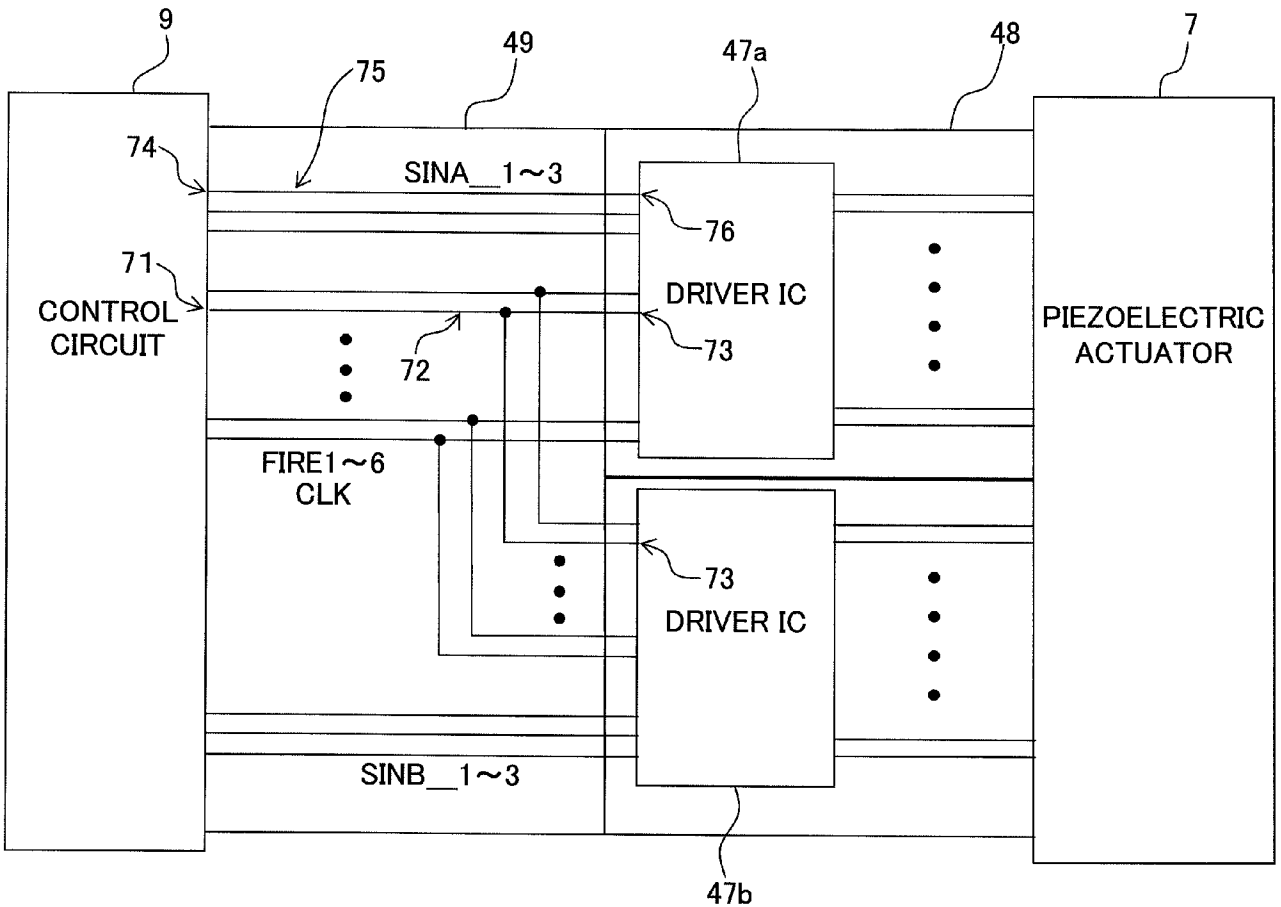
FIG. 5 is a diagram showing schematically connections of a piezoelectric actuator and a control circuit.

Next, connections between the piezoelectric actuator 7 of the ink-jet head 3 and a control circuit 9 of the printer 1 will be described below. As shown in FIG. 5, one of driver ICs 47*a* and 47*b* (driving circuits) which drive the piezoelectric actuator 7 is mounted on two FPCs (Flexible Printed Circuits) 48 connected to the piezoelectric actuator 7. Moreover, the two FPCs 48 are connected also to a flexible flat cable (FFC) 49, and furthermore, the FFC 49 is connected to the control circuit 9. A signal system from the control circuit 9 up to the driver IC 47, includes the control circuit 9, the driver IC 47, and signal wires and connecting portions such as the FPC 48 and the FFC 49 which connect the control circuit 9 and the driver IC 47. The signal system corresponds to a drive control apparatus in the present teachings.

Each of the driver ICs 47*a* and 47*b* applies an electric potential in advance, to half of the individual electrodes 42 which are associated, from among all the individual electrodes 42 of the piezoelectric actuator 7. Moreover, each of the driver ICs 47*a* and 47*b* applies selectively one of the predetermined electric potential and the ground electric potential to the plurality of individual electrodes 42 of the piezoelectric actuator 7 via wires on the FPC 48, based on a signal inputted from the control circuit 9 via the FFC 49.

Here, various input signals inputted from the control circuit 9 to the driver IC 47 will be described briefly. CLK indicates a data transfer clock from the control circuit 9 to the driver IC 47. Moreover, FIRE 1 to FIRE 6 are driving waveform data of six types corresponding to jetting modes of six types for the nozzle 30. Here, the jetting modes of six types include a non jetting mode in which no liquid droplets are jetted, and five liquid droplet jetting modes corresponding to a size of liquid droplets (volume of liquid droplets) to be jetted of five types. SINA_1 to SINA_3, and SINB_1 to SINB_3 are serial inputs of selection data of three bits for associating one of the six types of jetting modes at each jetting time of each nozzle 30.

Out of the various input signals described above, CLK and FIRE 1 to FIRE 6 are signals to be input at the same time and with the same waveform, to the two driver ICs 47*a* and 47*b*. Consequently, a common signal-output terminal 71 of the control circuit 9 which outputs these signals is connected to a common signal-input terminal 73 of the driver ICs 47*a* and 47*b* via a common signal wire 72 which is branched corresponding to the driver ICs 47*a* and 47*b* on the FFC 49, with an object of lining-saving. In other words, one common signal-output terminal 71 is connected to two common signal-input terminals 73 via the common signal wire 72.

Moreover, signals SINA_1 to SINA_3, and signals SINB_1 to SINB_3 are inputted individually at different timings and with different waveforms to the two driver ICs 47*a* and 47*b*. Consequently, an individual signal-output terminal 74 of the control circuit 9 which outputs this signal is connected to individual signal-input terminal 76 of the driver ICs 47*a* and 47*b* via an individual signal wire 75. In other words, one individual signal-output terminal 74 is connected to one individual signal-input terminal 76 via the individual signal wire 75.

Figure 6:
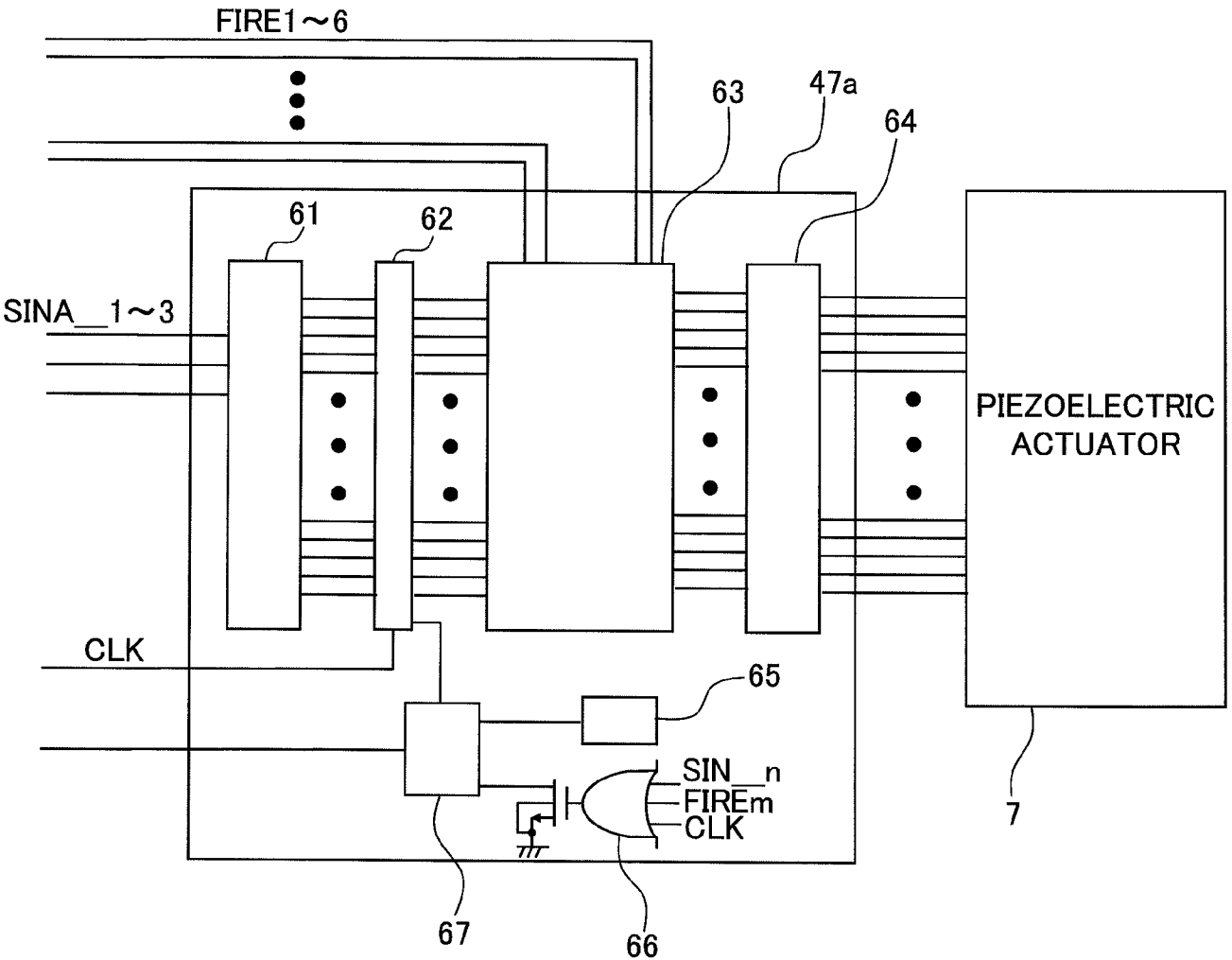
FIG. 6 is a block diagram of a driver IC.

Next, the driver IC 47 will be described below with reference to FIG. 6. Here, the driver IC 47*a* will be described. Since the driver IC 47*b* is similar to the driver IC 47*a*, the description thereof will be omitted. As shown in FIG. 6, the driver IC 47*a* includes a serial-parallel conversion circuit 61, a latching circuit 62, a waveform selecting circuit 63, a drive buffer 64, a temperature sensor 65 (operation-signal generating circuit), a checking circuit 66 (connection-signal generating circuit), and a signal selecting circuit 67.

The serial-parallel conversion circuit 61 converts, to a parallel signal, the signals "SINA_1 to SINA_3" which are input serially from the control circuit 9 via the individual signal wire 75, and outputs to the latching circuit 62. The latching circuit 62 is a so-called D flip-flop (digital flip-flop), and outputs data outputted as parallel from the serial-parallel conversion circuit 61 all together upon synchronizing with a transfer clock CLK, to the waveform selecting circuit 63. The waveform selecting circuit 63 is a so-called multiplexer, and selects one waveform signal from among the waveform signals FIRE 1 to FIRE 6, corresponding to the data outputted from the latching circuit 62, and outputs the selected waveform signal to the drive buffer 64. The drive buffer 64 amplifies the waveform signal selected and inputted by the waveform selecting circuit 63, to a voltage which is suitable for the piezoelectric actuator 7, and the amplified waveform signal is inputted to each of the plurality of individual electrodes 42 of the piezoelectric actuator 7 as a driving electric potential.

The temperature sensor 65 which is a sensor such as a thermistor, detects a temperature of the driver IC 47*a* (or 47*b*), and outputs, to the signal selecting circuit 67, a temperature detection signal (operation signal) of an electric potential level between 1V and 2V approximately corresponding to the detected temperature. Higher the temperature detected, lower is an electric potential level of the temperature detection signal outputted from the temperature sensor 65. Moreover, due to characteristics of the thermistor, the temperature detection signal neither becomes 0 V nor becomes a signal of an electric potential level higher than 3.3 V. In other words, the output signal of the thermistor always ranges between 0 V and 3.3 V. When there is a trouble in the driver IC, sometimes there is an abnormal heating of the driver IC. By observing the temperature detection signal of the temperature sensor 65, it is possible to detect whether there is an abnormal heat release from the driver IC. The temperature sensor 65 may not be necessarily measuring the temperature of the driver IC directly, and may measure a temperature of a portion which reflects the temperature of the driver IC (such as a temperature of air around the drive IC, and a temperature of a member which is directly/indirectly thermally contacted with the driver IC).

The checking circuit 66 detects whether or not various input signals from the control circuit 9 (such as signals from SINA 1 to SINA 3, signals from SINB 1 to SINB 3, signals from FIRE 1 to FIRE 6, and CLK) are input appropriately without an electrical conduction defect in the signal system, and outputs a connection signal corresponding to a detection result, to the signal selecting circuit 67. The checking circuit 66 outputs a connection signal of H level (here, 3.3 V) through the FET when all the connected signal wires are at L level (here, 0 V), and outputs a connection signal of L level through the FET, when at least one signal wire is at H level.

Consequently, the H level is outputted only for the signal wire which is to be detected for an electrical conduction defect from the control circuit 9, and the L level is outputted to the other signal wires. When there is an electrical conduction defect in any of the signal wires, no H level is inputted to the checking circuit 66 from the signal wire having the electrical conduction defect. Therefore, the L level is inputted to the checking circuit 66 from all the signal wires, and a connection signal of the H level (the second electric potential) is outputted from the checking circuit 66. Moreover, when there is no electrical conduction defect, the H level is inputted to the checking circuit 66 from a signal wire which is to be checked for an electrical conduction defect, and a connection signal of the L level (the first electric potential) is outputted from the checking circuit 66.

The signal connecting circuit 67 selects one of the temperature detection signal outputted from the temperature sensor 65 and the connection signal outputted from the checking circuit 66, based on the selection signal of one bit ("1" or "0") outputted from the control circuit 9 via the individual signal wire 75, and the signal connecting circuit 67 outputs the selected signal. In the embodiment, the signal selecting circuit 67 outputs the connection signal when the selection signal ("1") is input, and outputs the temperature detection signal when the selection signal ("0") is input.

Figure 7:
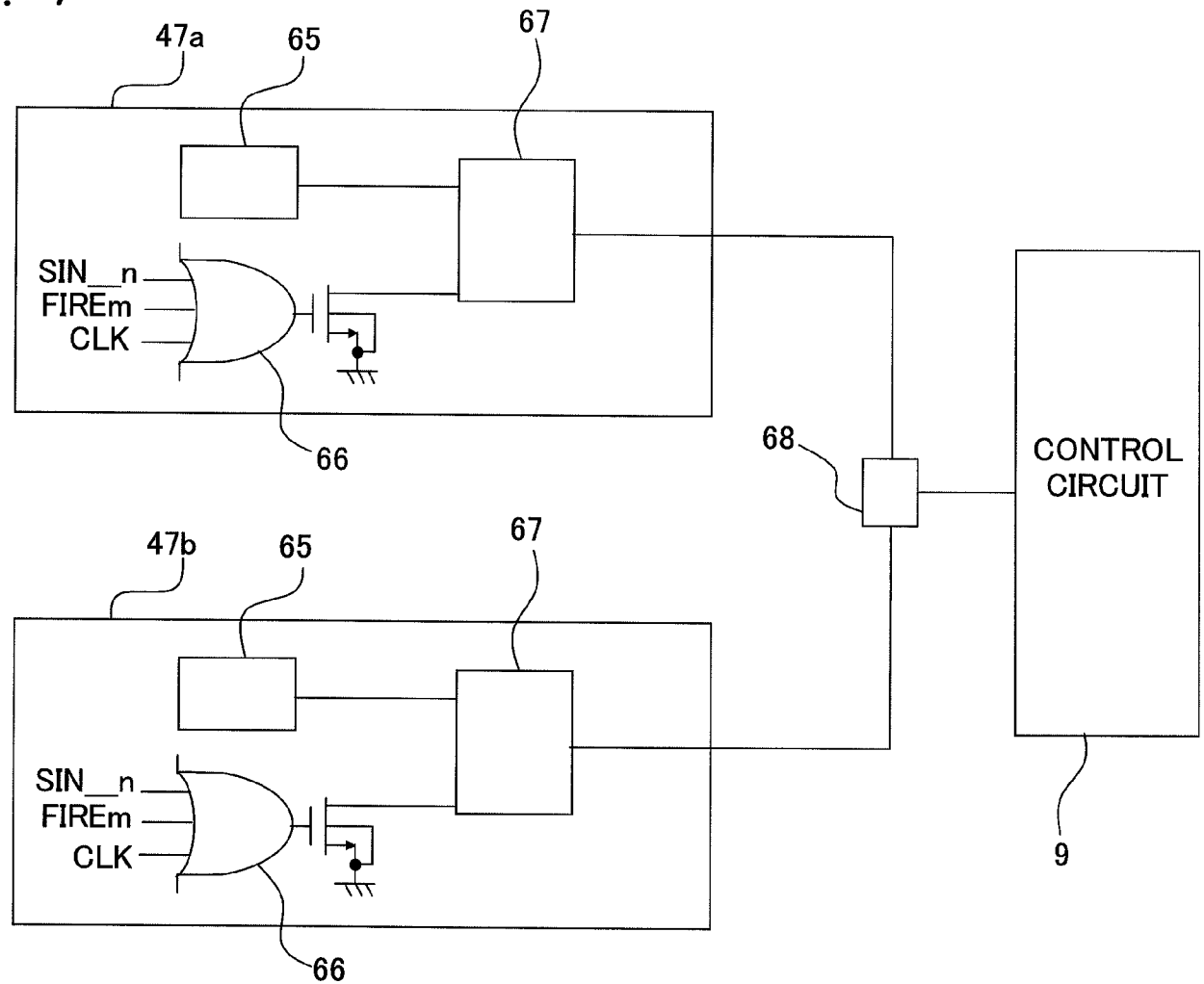
FIG. 7 is a diagram explaining about checking of an electrical conduction defect in a signal system.

As shown in FIG. 7, the output wires from the signal selecting circuits 67 of the two driver ICs 47*a* and 47*b* to the control circuit 9 are joined into one signal wire by a wired OR 68 for the purpose of lining-saving. The wired OR 68 outputs an output signal of the lowest electric potential level from among the electric potential levels of the plurality of output signals outputted from the signal selecting circuits 67.

Here, a process of checking whether there is an electrical conduction defect in a signal system from the control circuit 9 up to the driver ICs 47*a* and 47*b* via the signal wires will be described below with reference to FIGS. 8 and 9.

Firstly, as an example of an electrical conduction defect check of a common signal system from the control circuit 9 up to the driver ICs 47*a* and 47*b* via the common signal wire 72, an electrical conduction defect check of a common signal system to which the waveform signal FIRE 1 is outputted will be described below. The common signal wire 72 is connected upon branching to the common signal input terminals 73 of the two driver ICs 47*a* and 47*b*. In the embodiment, it is possible to detect an occurrence of an electrical conduction defect somewhere in the common signal system. Further, it is also possible to specify the signal wire, in the common signal system of the driver ICs 47*a* and 47*b*, at which there is an electrical conduction defect.

To start with, the selection signal (1) is inputted to the signal selecting circuit 67 of the driver IC 47*a* which is connected via the common signal wire 72 to the common signal output terminal 71 to which the waveform signal FIRE 1 of the control circuit 9 is outputted so that the signal selecting circuit 67 outputs the connection signal of the checking circuit 66. The selection signal (0) is inputted to the signal selecting circuit 67 of the other driver IC 47*b* to output the temperature detection signal of the temperature sensor 65.

Figure 8A:
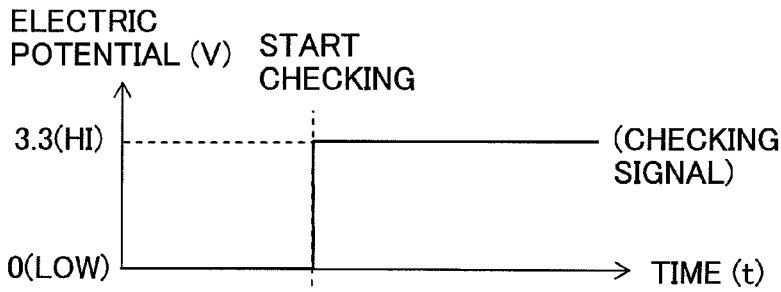
FIGS. 8A, 8B, 8C and 8D are diagrams showing a time change of an electric potential level of each component when there is no electrical conduction defect.
Figure 8B:
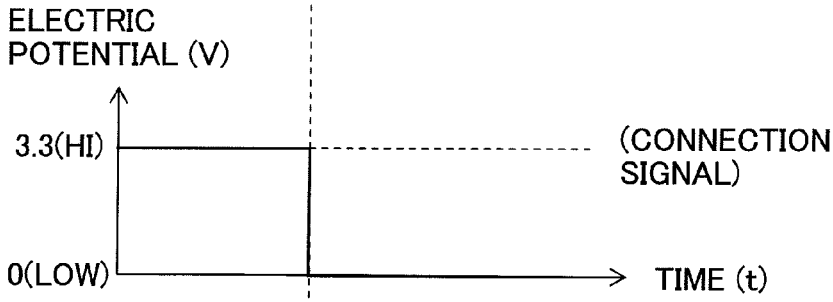
Figure 8C:
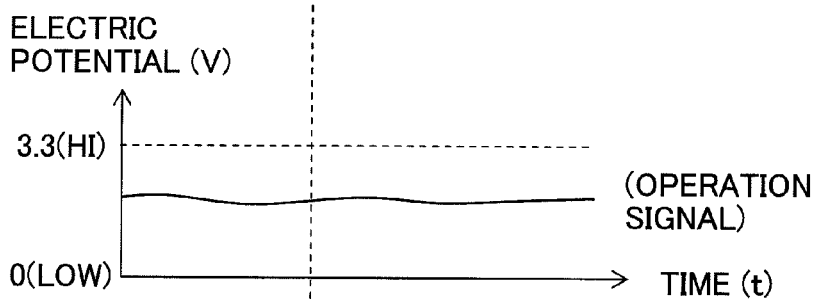
Figure 8D:
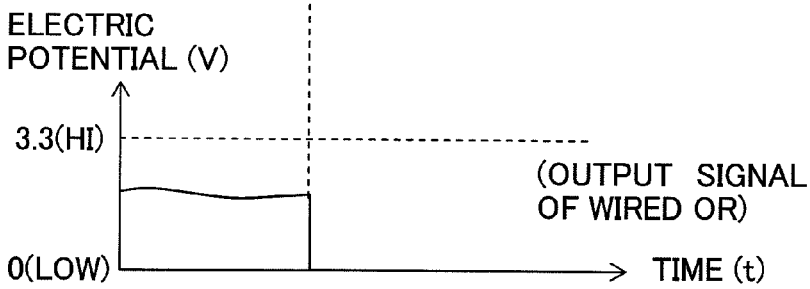

Moreover, as shown in FIG. 8A, the checking signal of H level is outputted to the common signal output terminal 71 to which the waveform signal FIRE 1 of the control circuit 9 is outputted. As the checking signal of the H level is outputted, the checking signal is inputted to the common signal input terminal of the driver IC 47*a* via the common signal wire 72, and is inputted to the corresponding checking circuit 66. At this time, when there is no electrical conduction defect in the common signal system, and when the checking signal is inputted appropriately to the checking circuit 66, the checking circuit 66 outputs L level through the FET as shown in FIG. 8B. Moreover, the connection signal of the L level of this checking circuit 66 is outputted from the signal selecting circuit 67 of the driver IC 47*a*. A temperature detection signal of the temperature sensor 65, an electric potential level of which is higher than the L level and is lower than the H level, is outputted from the signal selecting circuit 67 of the other driver IC 47*b* as shown in FIG. 8C. As shown in FIG. 8D, an output signal of the L level of the signal selecting circuit 67 of the driver IC 47*a* an electric potential level of which is lower than that of the output signal of the signal selecting circuit 67 of the driver IC 47*b*, is outputted from the wired OR 68.

Before checking the electrical conduction defect, since the L level is outputted to the checking circuit 66 of the driver IC 47*a*, the signal selecting circuit 67 of the driver IC 47*a* outputs the H level through the FET. Moreover, as shown in FIG. 8D, a temperature detection signal, an electric potential level of which is lower than the H level of the signal selecting circuits 67 of the driver ICs 47*a* and 47*b* is outputted from the wired OR 68.

Figure 9A:
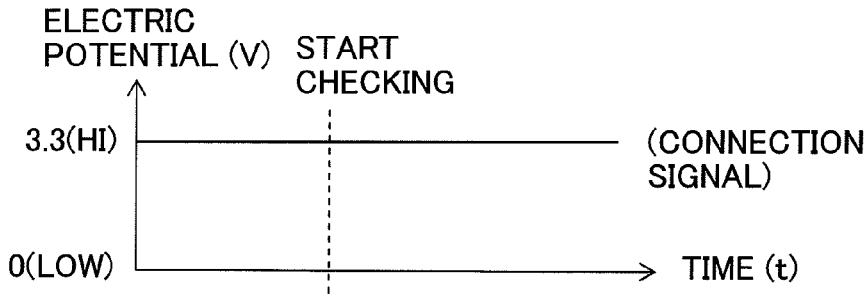
FIGS. 9A, 9B and 9C are diagrams showing the time change in the electric potential level of each component when there is an electrical conduction defect.
Figure 9B:
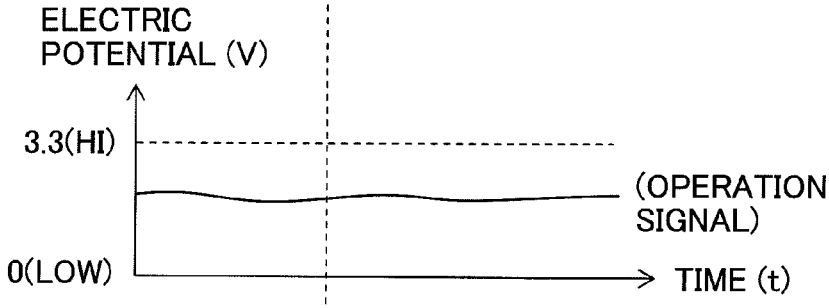
Figure 9C:
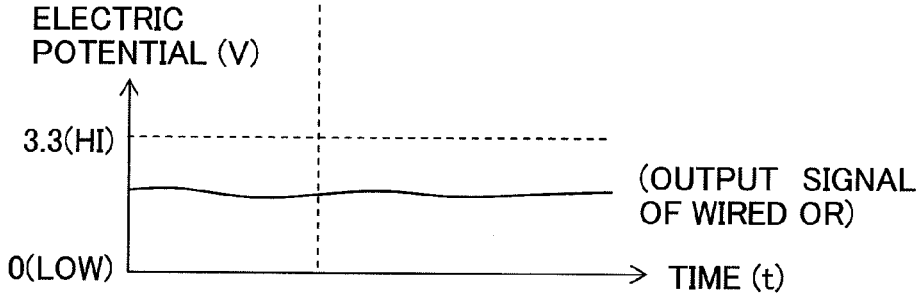

Moreover, when the checking signal is not input appropriately to the checking circuit 66, the checking circuit 66 outputs the connection signal of the H level as shown in FIG. 9A. The connection signal of the H level of the checking circuit 66 is outputted from the signal selecting circuit 67 of the driver IC 47*a*. As shown in FIG. 9B, a temperature detection signal of the temperature sensor 65 is outputted from the signal selecting circuit 67 of the other driver IC 47*b*. Moreover, as shown in FIG. 9C, an output signal of the signal selecting circuit 67 of the driver IC 47*b*, an electric potential level of which is lower than the output signal of the H level of the signal selecting circuit 67 of the driver IC 47*a*, is outputted from the wired OR 68.

Consequently, when the electric potential level of the output signal outputted from the wired OR 68 to the control circuit 9 is switched, to the L level, from an electric potential level of the temperature detection signal between the H level and the L level it is possible to detect that an electrical conduction defect has not occurred in the corresponding common signal system. Moreover, when the electric potential level of the output signal outputted from the wired OR to the control circuit 9 is between the H level and the L level, it is possible to detect that an electrical conduction defect has occurred in the corresponding common signal system.

Moreover, at the time of detecting whether or not there is an electrical conduction defect in the common signal system from the control circuit 9 up to the driver IC 47*b*, the connection signal of the checking circuit is made to be output only from the signal selecting circuit 67 of the driver IC 47*b*, and the temperature detection signal of the temperature sensor 65 is made to be output from the signal selecting circuit 67 of the other driver IC 47*a*. When it is detected that an electrical conduction defect has occurred in the common signal system from the control circuit 9 up to the driver IC 47*a*, and that an electrical conduction defect has also occurred in the common signal system up to the driver IC 47*b*, it is possible to detect that there is an electrical conduction defect in the common signal system of the common signal wires from the control circuit 9 up to one of the drivers IC 47*a* and 47*b* before branching, or it is possible to detect that there is an electrical conduction defect in the common signal system of the common signal wires from the control circuit 9 up to both of the drivers IC 47*a* and 47*b* after branching.

Checking of an electrical conduction defect in the individual signal system from the control circuit 9 up to the driver ICs 47*a* and 47*b* via the individual signal wires 75 also is similar as checking of an electrical conduction defect in the common signal system which has been described above. In a normal case, a connection signal of the L level is outputted from the checking circuit 66 of the driver ICs 47*a* and 47*b* connected to the signal wires for which the electrical conduction defect is to be checked, and a connection signal of the H level in an unchecked state is outputted from the checking circuit 66 of the remaining driver ICs 47*a* and 47*b*. Therefore, even when the connection signal of the checking circuit 66 is outputted from the signal selecting circuit 67 of all the driver ICs 47*a* and 47*b*, it is possible to detect whether or not there is an electrical conduction defect.

In such manner, while facilitating the lining-saving, it is possible to detect whether there is an electrical conduction defect in the individual signal system and the common signal system, and furthermore, it is possible to detect as to which of the common signal systems has an electrical conduction defect, from among the common signal system to the driver IC 47*a* and the common signal system to the driver IC 47*b*.

Next, modified embodiments in which various modifications are made in the embodiment will be described below. However, same reference numerals are assigned to components which are similar as in the embodiment, and the description of such components is omitted.

In the embodiment, there are two driver ICs driving the piezoelectric actuator 7. However, there may be three or more driver ICs. Even in this case, it is possible to check an electrical conduction defect in the signal system when the connection signal of the checking circuit 66 is outputted only from the signal selecting circuit 67 of the driver IC to which the signal wire for which the electrical conduction defect is to be checked is connected, and when the temperature detection signal of the temperature sensor 65 is outputted from the signal selecting circuit 67 of the remaining driver ICs.

Moreover, in the embodiment, when the connection signal of the checking circuit 66 is not outputted from the signal selecting circuit 67, the temperature detection signal of the temperature sensor 65 is used as the operation signal of the operation-signal generating circuit outputted from the signal selecting circuit 67. However, a circuit for debugging which checks transceiving of a signal from the control circuit 9 to the driver ICs 47*a* and 47*b* may be used as the operation-signal generating circuit, and a debug signal which is output as a confirmation of transceiving of a signal from the circuit for debugging may be used as the operation signal.

Moreover, in the embodiment, a signal of the H level of DC output has been output as a checking signal from the control circuit 9 to the checking circuit 66. However, a pulse signal which assumes the H level from the L level, and which assumes the L level again may be output as the checking signal. When the electric potential level of the temperature detection signal outputted from the temperature sensor 65 corresponding (according) to the temperature of the driver ICs 47*a* and 47*b* becomes closer to the L level of the connection signal which is output from the checking circuit 66, it is difficult to know as to which of the connection signal and the operation signal is the output from the wired OR 68, and there is a possibility of misdetection. Therefore, by letting the checking signal to be a pulse signal, and letting the connection signal corresponding to this to be a pulse output, when there is an electrical conduction defect, the pulse signal is output from the wired OR 68. Therefore, it is possible to prevent the operation signal and the connection signal from being distinguished mistakenly by detecting an instantaneous rise and fall (trail) of this pulse signal.

Further, in the embodiment, the checking circuit 66 outputs the connection signal of the L level when the checking signal is inputted appropriately, and the checking circuit 66 outputs the connection signal of the H level when the checking signal is inputted appropriately. Moreover, when there is no electrical conduction defect in the signal systems, the wired OR 68 outputs the connection signal of the L level, which is lower than the electric potential level of the temperature detection signal, and when there is an electrical conduction defect in the signal systems, the wired OR 68 outputs the temperature detection signal, the electric potential level of which is lower than the electric potential level of the connection signal of the H level. However, the checking circuit 66 may output the connection signal of the H level when the checking signal is inputted appropriately, and the checking circuit 66 may output the connection signal of the L level when the checking signal is not inputted appropriately. In this case, when there is no electrical conduction defect in the signal system, the wired OR 68 outputs the temperature detection signal of the electric potential level lower than the electric potential level of the connection signal of the H level, and when there is an electric conduction defect in the signal system, the wired OR 68 outputs the connection signal of the L level of the electric potential level lower than the electric potential level of the temperature detection signal. At this time, when there is an electrical conduction defect in the signal system, the output signal of the wired OR 68 is switched from the temperature detection signal to the L level, and it is possible to detect whether there is an electrical conduction defect.

In the description made above, each output from the signal selecting circuit of the plurality of driver ICs has been put together in one signal wire by the wired OR. However, the present teachings are not restricted to such arrangement, and it is also possible to use a logic circuit (an electronic circuit) which is formed by combining appropriate components, for example. Incidentally, as it has been mentioned above, when the plurality of signal wires is put together in one wire by the wired OR, a signal of the lower electric potential level from among the plurality of signal wires is output. In a case of putting together the plurality of signal wires in one single wire by using the logic circuit, the signal of the lowest electric potential level may not be output necessarily, and a signal of the highest electric potential level may be output. For example, a case in which, the checking circuit 66 outputs the connection signal of the L level when the checking signal has been input appropriately, and the checking circuit 66 outputs the connection signal of the H level when the checking signal has not been input appropriately will be taken into consideration. When there is no electrical conduction defect in the signal system, since the electric potential level of the intermediate level temperature detection signal is higher than an electric potential level of the connection signal of the L level, the logic circuit outputs the temperature detection signal of the intermediate level. Whereas, when there is an electrical conduction defect in the signal system, the logic circuit outputs the connection signal of the H level. The wired OR and the logic circuit correspond to the output signal integrating section of the present teachings.

Moreover, in the abovementioned description, the temperature detection signal from the temperature sensor or the debug signal has been used as a signal of an intermediate electric potential between the L level and the H level. However, the present teachings are not restricted to such arrangement and, an arbitrary signal source may be used as long as the signal of the intermediate electric potential between the L level and the H level, may be output steadily (constantly). For example, a battery or a small-size constant voltage circuit may be used instead of the temperature sensor.

In the embodiment and the modified embodiments described above, the present teaching has been applied to a drive control apparatus which includes a plurality of driver ICs which drive the piezoelectric actuator having a plurality of recording elements in an ink jet printer which records an image etc. by jetting an ink onto a recording paper. However, an application of the present invention is not restricted to the drive control apparatus of the piezoelectric actuator having such plurality of recording elements, and the present invention is also applicable to a drive control apparatus of an actuator having a plurality of drive elements used for various applications. For example, the present invention is also applicable to a drive control apparatus including a plurality of driver ICs which drive a display having a plurality of light emitting elements.

What is claimed is:

1. A drive control apparatus which controls a drive target, comprising:

a control circuit which has:

a plurality of individual signal-output terminals; and a common signal-output terminal;

wherein the control circuit outputs a predetermined checking signal from the common signal-output terminal; and wherein the control circuit outputs a predetermined selection signal from one of the individual signal-output terminals;

a plurality of driving circuits which drives the drive target based on a signal inputted from the control circuit, each of the driving circuits including:

a plurality of individual signal-input terminals;

a common signal-input terminal;

a connection-signal generating circuit which outputs a connection signal, where an electric potential level of the connection signal is a predetermined first electric potential, under a condition that the checking signal outputted from the common signal-output terminal of the control circuit is inputted to the connection-signal generation circuit, and where the electric potential level of the connection signal is a predetermined second electric potential that differs from the first electric potential, under a condition that no checking signal is inputted to the connection-signal generation circuit;

an operation-signal generating circuit which outputs an operation-signal, an electrical potential level of which is between the first electric potential and the second electric potential; and a connection-signal selecting circuit to which the connection signal outputted from the connection-signal generating circuit and the operation-signal outputted from the operation-signal generating circuit are inputted;

wherein the connection-signal selecting circuit selects, based on the selection signal inputted from the control circuit, one of the connection signal and the operation-signal, and outputs the selected signal as an output signal;

a plurality of individual signal wires which connect the individual signal-output terminals of the control circuit and the individual signal-input terminals of each driving circuit respectively;

a common signal wire which connects in common, the common signal-input terminal of each of the driving circuits and the common signal-output terminal of the control circuit; and an output-signal integrating section which integrates the output signals of the connection-signal selecting circuits to one output signal such that the output-signal integrating section outputs one of an output signal of a highest electric potential level and an output signal of a lowest electric potential level, among the output signals of the connection-signal selecting circuits;

wherein the control circuit outputs a first selection signal, by which the connection-signal selecting circuit, for one driving circuit among the driving circuits in which a connection state with the control circuit is checked, is made to select and output the connection signal; and wherein the control circuit outputs at least one second selection signal by which the connection-signal selecting circuit, for at least one other driving circuit among the driving circuits, is made to select and output the operation-signal.

2. The drive control apparatus according to claim 1;

wherein each operation-signal generating circuit outputs an operation signal related to an operation state of the drive target.

3. The drive control apparatus according to claim 2;

wherein, in the output-signal integrating section, outputs of the connection-signal selecting circuits of all the driving circuits are made as one output by a wired OR.

4. The drive control apparatus according to claim 3;

wherein at least one of the operation-signal generating circuits outputs a temperature detection signal corresponding to an operation temperature of each of the driving circuits, as the operation signal.

5. The drive control apparatus according to claim 3;

wherein the control circuit outputs a pulse signal to each connection-signal generating circuit, as the checking signal, a HIGH level and a LOW level of the pulse signal being the first electric potential and the second electric potential, respectively; and wherein each connection-signal generating circuit outputs the connection signal in a form of a pulse corresponding to the pulsed checking signal to the respective signal connecting circuit.

6. The drive control circuit according to claim 1;

wherein each connection-signal generating circuit includes:

an FET; and a plurality of input terminals which are connected to the common signal-output terminals and the individual signal-output terminals, of the control circuits;

wherein the FET outputs a connection signal of a HIGH level, under a condition that an electric potential level of the checking signal inputted to each of the input terminals is a LOW level, and the FET outputs a connection signal of a LOW level, under a condition that an electric potential level of the checking signal inputted to at least one of the input terminals is a HIGH level.

7. An ink-jet printer which records an image by jetting an ink onto a medium, comprising:

an ink-jet head including:

a channel unit which includes:

nozzles through which an ink is jetted; and channels which communicate with the nozzle; and a piezoelectric actuator which applies a jetting pressure to the ink in the channels;

the drive control apparatus as recited in claim 1, which controls the ink-jet head; and a transporting mechanism which transports the medium relative to the ink-jet head.

8. A drive control apparatus which controls a drive target, comprising:

a control circuit which has:

a plurality of individual signal-output terminals; and a common signal-output terminal;

wherein the control circuit outputs a predetermined checking signal from the common signal-output terminal; and wherein the control circuit outputs a predetermined selection signal from one of the individual signal-output terminals;

a plurality of driving circuits which drives the drive target based on a signal inputted from the control circuit, each of the driving circuits including:

an individual signal-input terminal;

a common signal-input terminal;

a connection-signal generating circuit which outputs a connection signal, where an electric potential level of the connection signal is a predetermined first electric potential, under a condition that the checking signal outputted from the common signal-output terminal of the control circuit is inputted to the connection-signal generation circuit, and where the electric potential level of the connection signal is a predetermined second electric potential that differs from the first electric potential, under a condition that no checking signal is inputted to the connection-signal generation circuit;

an operation-signal generating circuit which outputs an operation-signal, an electrical potential level of which is between the first electric potential and the second electric potential; and a connection-signal selecting circuit to which the connection signal outputted from the connection-signal generating circuit and the operation-signal outputted from the operation-signal generating circuit are inputted;

wherein the connection-signal selecting circuit selects, based on the selection signal inputted from the control circuit, one of the connection signal and the operation-signal, and outputs the selected signal as an output signal;

a plurality of individual signal wires, each of which connects one of the individual signal-output terminals of the control circuit and the individual signal-input terminal of one of the driving circuits;

a common signal wire which connects in common, the common signal-input terminal of each of the driving circuits and the common signal-output terminal of the control circuit; and an output-signal integrating section which integrates the output signals of the connection-signal selecting circuits to one output signal such that the output-signal integrating section outputs one of an output signal of a highest electric potential level and an output signal of a lowest electric potential level, among the output signals of the connection-signal selecting circuits;

wherein the control circuit outputs a first selection signal, by which the connection-signal selecting circuit, for one driving circuit among the driving circuits in which a connection state with the control circuit is checked, is made to select and output the connection signal; and wherein the control circuit outputs at least one second selection signal by which the connection-signal selecting circuit, for at least one other driving circuit among the driving circuits, is made to select and output the operation-signal.

* * * * *